US006890127B1

(12) United States Patent
Barrett et al.

(10) Patent No.: US 6,890,127 B1
(45) Date of Patent: May 10, 2005

(54) SUBSURFACE PLATFORMS FOR SUPPORTING BRIDGE/CULVERT CONSTRUCTIONS

(76) Inventors: Robert K. Barrett, 549 S. Broadway, Grand Junction, CO (US) 81503; Albert C. Ruckman, 11488 Nucla, Commerce City, CO (US) 80022

( * ) Notice: Subject to any disclaimer, the term of this patent is extended or adjusted under 35 U.S.C. 154(b) by 0 days.

(21) Appl. No.: 10/745,902

(22) Filed: Dec. 23, 2003

(51) Int. Cl.[7] ..... E02B 3/04
(52) U.S. Cl. ..... 405/73; 405/229
(58) Field of Search ..... 14/26, 77.1, 71; 405/15, 21, 23, 25, 73, 125, 229, 230, 231

(56) References Cited

U.S. PATENT DOCUMENTS

| | | | | |
|---|---|---|---|---|
| 571,225 | A | 11/1896 | Geisel | 52/87 |
| 3,808,624 | A | 5/1974 | Barkdull, Jr. | 14/77.1 |
| 3,981,038 | A | 9/1976 | Vidal | 14/26 |
| 4,181,995 | A | 1/1980 | Zur | 14/77.1 |
| 4,564,313 | A | 1/1986 | Niswander et al. | 405/125 |
| 4,564,967 | A | 1/1986 | Vidal | 14/75 |
| 4,655,637 | A * | 4/1987 | Vignocchi | 405/17 |
| 4,993,872 | A | 2/1991 | Lockwood | 405/125 |
| 5,044,831 | A | 9/1991 | Myles et al. | 405/259 |
| 5,549,418 | A | 8/1996 | Devine et al. | 405/258.1 |
| 5,713,162 | A | 2/1998 | Gallo et al. | 52/167.1 |
| 6,533,498 | B1 | 3/2003 | Quin | 405/125 |
| 6,745,421 | B2 * | 6/2004 | Barrett et al. | 14/26 |

OTHER PUBLICATIONS

Bridge Technology, U.S. Department of Transportation FHA, Micropile—Design and Construction Guidelines, Aug. 2000.*
MICORPILES http://web.archive.org/web/199990220214103/ wolf.poly.edu/mp.html.*

* cited by examiner

*Primary Examiner*—Thomas B. Will
*Assistant Examiner*—Tara L. Mayo
(74) *Attorney, Agent, or Firm*—Sheridan Ross PC

(57) ABSTRACT

A scour platform to prevent scour of a moving body of water is constructed by placing an excavation adjacent to the body of water. The excavation is spaced laterally from the body of water and extends up or downstream a desired length. A stabilizing sheet material covers the bottom of the excavation. Aggregate is placed within the excavation over the sheet material, and a free end of the sheet material is then folded back over the upper surface of the emplaced aggregate. Any remaining gaps between the excavation and the sheet material may be backfilled and compacted as necessary. The scour platform is completed once the free end of the sheet material is folded back over the aggregate. For additional prevention of scour, micropiles may be emplaced between the scour platform and the body of water.

11 Claims, 3 Drawing Sheets

Fig. 1
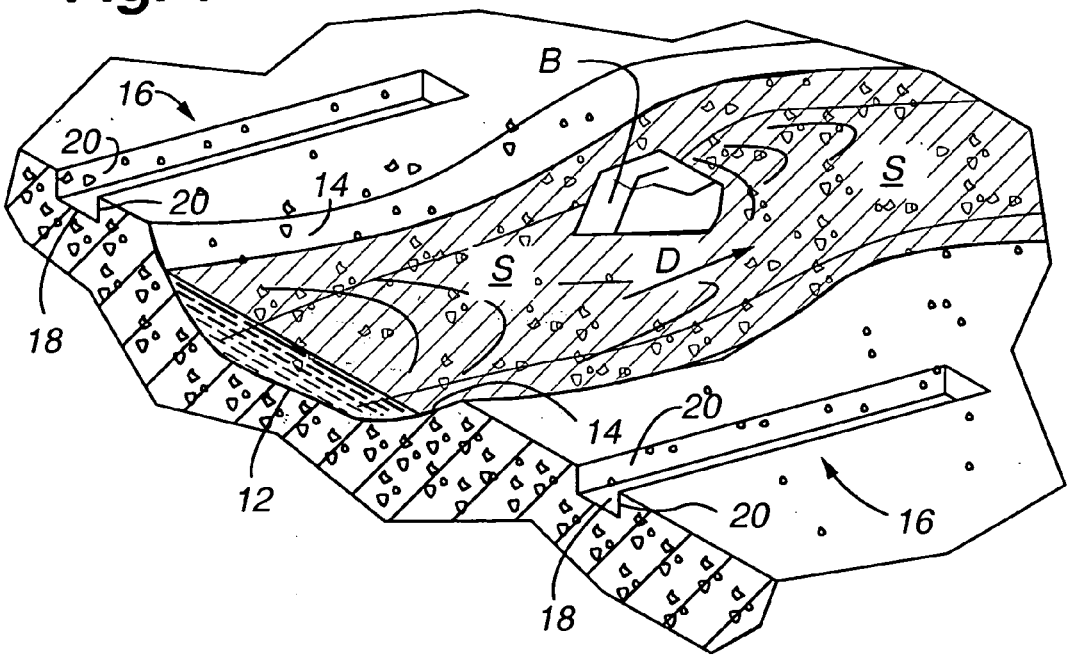
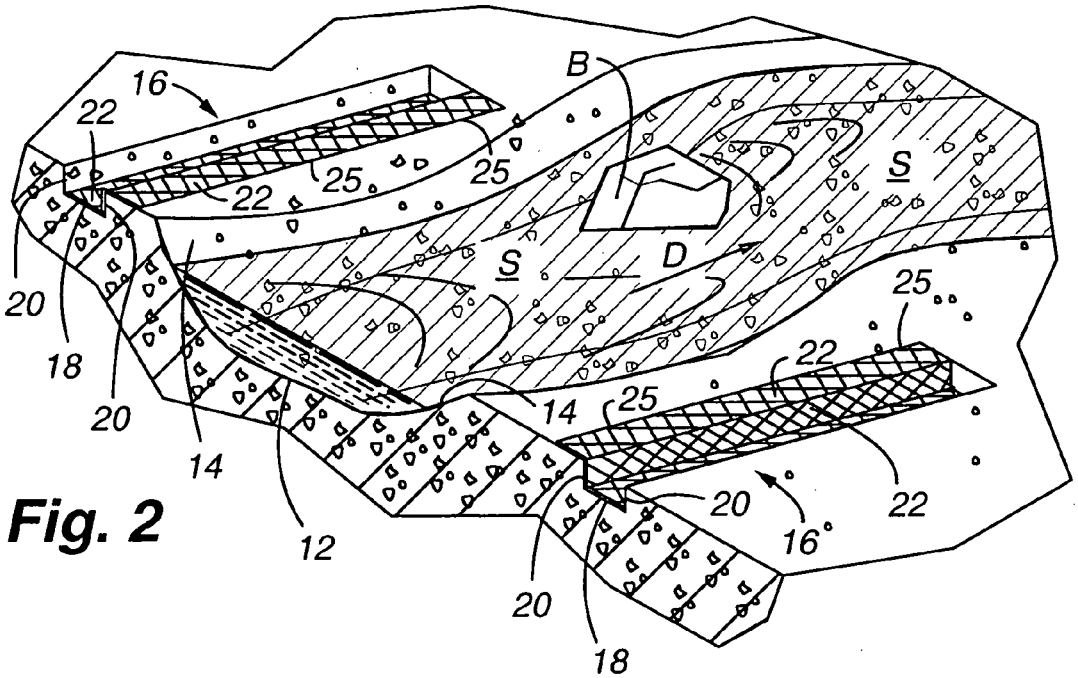
Fig. 2

SUBSURFACE PLATFORMS FOR SUPPORTING BRIDGE/CULVERT CONSTRUCTIONS

FIELD OF THE INVENTION

This invention relates to subsurface supports which may be used to support bridges and culverts, and more particularly, to a subsurface support in the form of a platform that prevents scour type erosion which may develop from a body of moving water such as a river or stream.

BACKGROUND OF THE INVENTION

Over time, rivers and streams continue to change course as these moving bodies of water erode the surrounding earth. One classic example of how a river may change course over time is the Colorado River and the formation of the Grand Canyon which has taken place over millions of years. Without intervention, all rivers and streams continue to change course as the force of moving water will erode surrounding earth in paths of least resistance.

When a structure is placed over a body of water, such as a bridge or culvert, it is necessary to take into account scour type erosion which will naturally take place. Such scour can occur in dramatic events such as floods, and will at least take place incrementally over time as the moving body of water continues to move particles of rock and soil downstream.

One of the most common means to ensure that a moving body of water such as a river stays its course through a built up area or at least through a manmade structure such as a bridge, is the use of a series of large boulders known as rip rap which may line the banks and/or bed of the river. Placing rip rap over an extended length of a river can be quite expensive and therefore infeasible. Such rip rap is typically quarried rock which must be transported to the work site and emplaced by heavy equipment. Due to recent environmental awareness, placing rip rap on the banks and bed of a stream can permanently alter not only the dynamic flow characteristics of the river, but also the ecological balance of flora and fauna which may reside or depend upon an undisturbed river bed and river banks. For migrating fish populations such as salmon, rip rap can significantly alter the dynamic flow characteristics of a stream to the extent that it makes migration difficult or impossible over certain stretches of a river. Another drawback with construction which utilizes rip rap is that emplacement of the rip rap will significantly alter water quality by at least temporarily increasing the amount of sediment which is suspended in the body of water. Certain populations of fish such as trout are particularly sensitive to water quality degradation. Because of such environmental concerns, a need has developed for the ability to prevent undesirable scour which will inevitably occur within a stream or river, yet provide manmade intervention in a manner that will not significantly alter either the characteristics of the stream or river, or the surrounding vegetation and terrain which runs adjacent to the stream bank.

SUMMARY OF THE INVENTION

In accordance with the present invention, a subsurface scour platform is provided for supporting bridge, culvert, and other manmade structures which must overly a body of moving water such as a river or stream. In the preferred embodiment of the present invention, an excavation is made which extends in the direction of flow of the moving body of water and is spaced laterally away from the river/stream bank. The excavation may be undrained which means that water may be allowed to seep into the excavation from uprising ground water which may be present adjacent the body of water. A layer of stabilizing sheet like material is placed on the bottom surface of the undrained excavation. The sheet-like material may include materials such as wire mesh, geosynthetic sheets, or combinations of both. After the bottom of the excavation has been lined with the sheet material, a fill material such as open graded rock then fills the excavation. A remaining length of the sheet material is then folded over the upper surface of the fill material thereby enclosing the fill within a U-shaped enclosure. Preferably, the free end of the remaining length extends away from the body of water.

An abutment of a bridge may then be placed directly over a constructed scour platform. Alternatively, any other structure may be placed over the scour platform if it is necessary to span the body of water at that location. A platform may be built for each abutment as necessary.

The sheet material in combination with the aggregate will prevent or greatly reduce the natural scouring action of the body of water from extending beyond an emplaced platform. The platform is best suited for smaller streams and rivers, and the maximum depth of the excavation is preferably 3 to 6 feet. Perhaps with the exception of a major flood, excavations which are dug to this depth will prevent the scouring action of the body of water for a great period of time. There is no required distance in which excavations should be placed laterally from the edges or banks of the body of water; however, normal scouring action of the body of water may continue to occur at normal rates until the flow/current of the body of water actually reaches the interior edges of emplaced scour platforms.

Although in most circumstances it is desirable to place a platform on each opposite side of a river or stream, it may only be necessary to provide a platform on one side of the body of water. Additionally, the scour platform of the present invention may extend downstream a desired length depending upon where it is desired to prevent scour. Although the scour platform of the present invention is ideally suited to provide support for an overlying structure such as an abutment, the scour platforms may be used alone to prevent scour, and vegetation may be planted over the top of the platforms to restore the area to its natural state.

The width of the excavations can also be modified as necessary to provide the desired resistance against scour as well as to accommodate a particular sized structure which may be placed on the scour platform. In larger rivers, it may be necessary to extend the width of the excavations to better resist the scouring force provided by the body of water.

In another aspect of the invention, additional means may be provided to further prevent scour by use of a plurality of micropiles which are driven in the ground adjacent an emplaced scour platform.

There are many advantages to the scour platform of the present invention. One distinct advantage is that rip rap is not required to stabilize the flow of a river thereby providing a much more cost effective solution. Since the body of water itself is not disrupted during construction, the water quality of the body of water will remain unaffected at all stages of platform construction. Additionally, since an excavation does not need to be dewatered, the scour platform further provides a cost effective alternative because no equipment is required to pump water or to otherwise keep the excavation dry. The scour platform provides an adequate base support for an overlying structure such as an abutment. Use of a scour platform requires minimum disruption of the surrounding terrain thereby allowing the terrain to be more easily restored to its natural state, to include the return of vegetation or other natural objects.

Other features and advantages of the present invention will become apparent from a review of the following description, taken in conjunction with the accompanying drawings.

BRIEF DESCRIPTION OF THE DRAWINGS

FIG. 1 is a cross-sectional view of a moving body of water such as a river, and a pair of undrained excavations which are emplaced on both sides of the body of water;

FIG. 2 is another cross-sectional diagram showing installation of sheet material;

DETAILED DESCRIPTION

Figure 3:
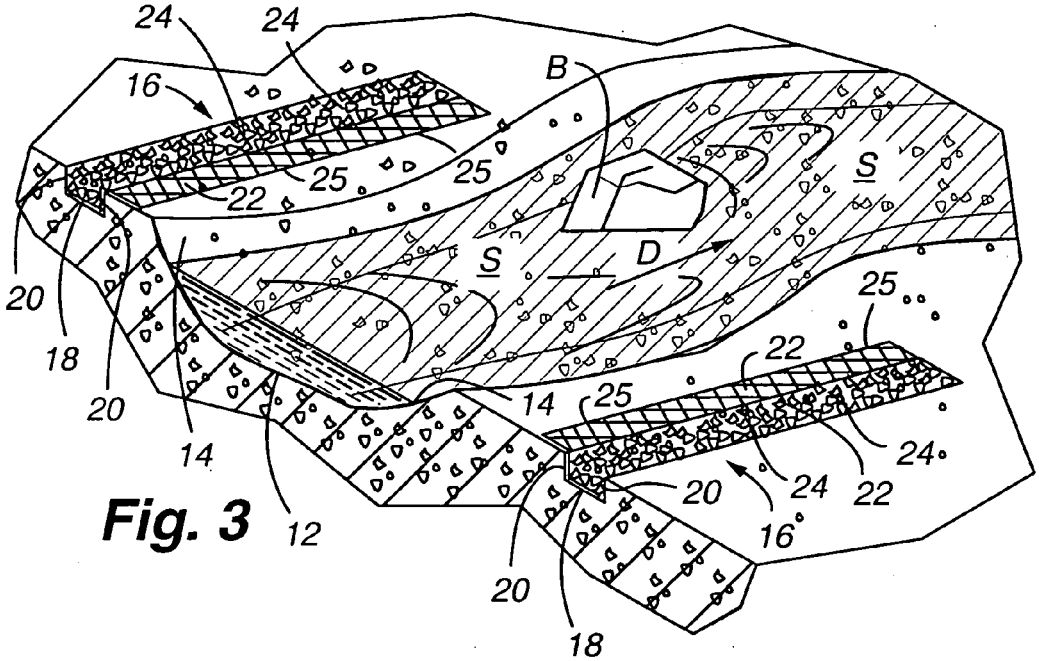
FIG. 3 illustrates emplacement of the aggregate within the excavations.
Figure 4:
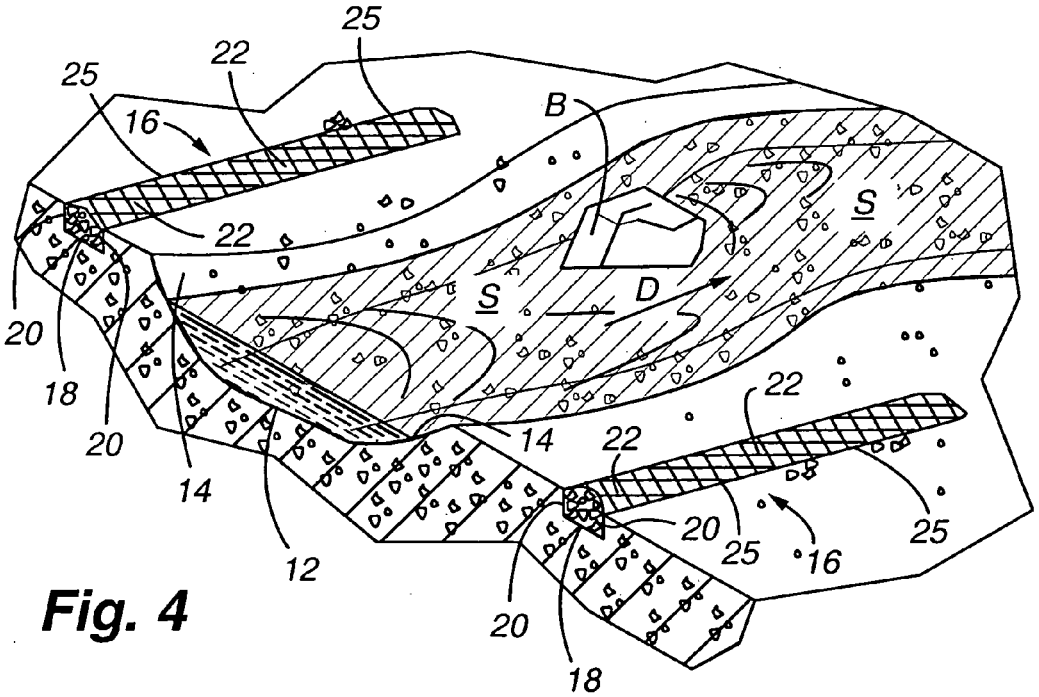
FIG. 4 illustrates completion of the scour platforms by folding the free ends of the sheet material over the upper surface of the aggregate.

FIG. 1 illustrates in cross-section a body of water such as a stream S which is flowing either upstream or downstream in a direction D. The stream is defined by a streambed 12, and banks 14 which rise above the level of the stream. The stream may have multiple other natural features such as boulders B, as well understood. Spaced laterally away from each of the banks 14 is an excavation 16 which generally extends in the same direction D as the stream. Preferably, an excavation is box-like which includes a flat bottom 18, and substantially perpendicular sidewalls 20. As mentioned above, a preferred maximum depth of an excavation is between about 3 to 6 feet, and the width can be variable depending upon design considerations in preventing scour from differing types of bodies of water. As shown in FIG. 2, a piece of sheet material 22 extending the length of each excavation 16 is placed to cover the bottoms 18, and the remaining widths of the sheet material 22 extend out from the excavations in the directions towards the stream. As shown in FIG. 3, an aggregate material 24, preferably in the form of open graded rock, then fills each excavation. As shown in FIG. 4, the free ends 25 of the sheet material 22 is then folded back over the upper surfaces of the emplaced aggregate 24 thereby closing the tops of the scour platforms. Any gaps which may remain between the sheet material and the excavations may be backfilled and compacted as necessary. When the free ends 25 of the sheet material are folded back over the upper surfaces of the aggregate, each sheet material forms a u-shape with the curved section of the u facing toward the body of water.

Figure 5:
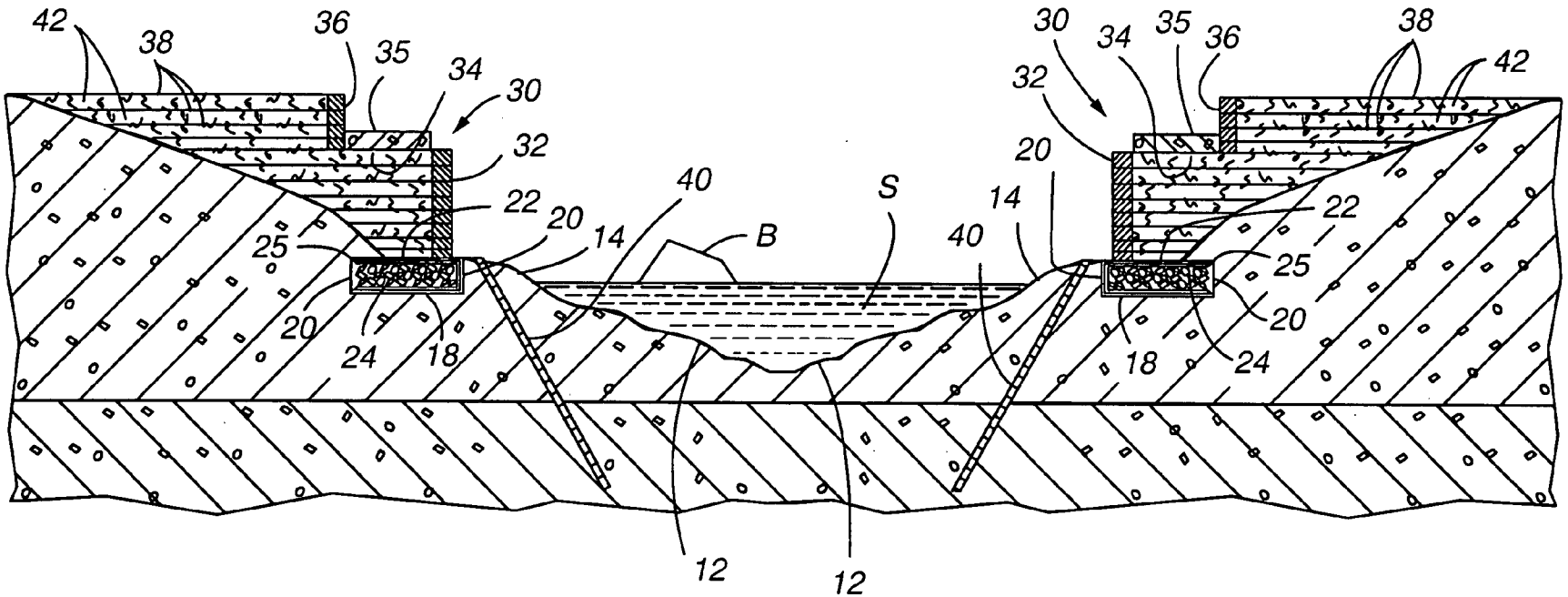
FIG. 5 is a cross-sectional view of a pair of scour platforms and corresponding abutments placed over the scour platforms, and use of micropiles to further stabilize the earth to prevent scour.

FIG. 5 illustrates bridge abutments placed over each of the scour platforms. The particular type of abutment which may be placed over the scour platforms is not limited to any particular abutment design, and those skilled in the art can envision multiple types of abutment designs which can be used. The particular abutments shown in FIG. 5 correspond to an abutment described and illustrated in our copending patent application entitled Abutment with Seismic Restraints, U.S. application Ser. No. 10/043,693 filed on Jan. 10, 2002, said application being incorporated herein by reference. In summary, the particular abutment 30 described therein is characterized by a facing wall 32, sill 34, rear wall 36, and bearing member 35 which may receive a girder/longitudinal support (not shown) of a bridge. The abutment body may be made from a plurality of layers of geotextile material 38, and fill material 42 which is placed between each layer 38.

FIG. 5 also illustrates use of one or more micropiles 40 which are driven into the ground, preferably at an angle towards the stream as shown. The micropiles may be spaced from one another in an upstream or downstream direction. The micropiles are preferably made from steel rods which have a coated surface to prevent undue corrosion.

From the foregoing, it is apparent that a cost effective and ecologically friendly solution is provided to prevent undesirable scouring, as well as to provide support for an overlying structure such as an abutment. Accordingly, scouring can be prevented without having to divert the body of water, or otherwise modify an existing stream bed and banks. Additionally, the excavations may be undrained which also thereby simplifies construction and minimizes man and equipment requirements.

The foregoing invention has been described with respect to a particular preferred embodiment; however, it shall be understood that various other modifications may be made within the spirit and scope of the present invention.

What is claimed:

1. A system to prevent scour created from a moving body of water, said system comprising:

an excavation placed adjacent a body of water and having a length extending along a flow direction of the water;

a sheet material placed on a bottom surface of the excavation, said sheet material having a free end that it is extendable outward and away from the excavation; and aggregate placed in the excavation, and wherein said free end of said sheet material is placed on top of the emplaced aggregate, said excavation, sheet material, and aggregate defining a scour platform; and a plurality of micropiles spaced from one another along the body of water and placed between an edge of the water and said scour platform.

2. A system, as claimed in claim 1, wherein:

said platform has an upper surface that substantially matches surrounding grade of the ground.

3. A system, as claimed in claim 1, wherein:

a depth of said excavation is between about 3 to 6 feet.

4. A system, as claimed in claim 1, wherein:

said sheet material is selected from the group consisting of wire mesh, geotextile sheets, and combinations thereof.

5. A system as claimed in claim 1, wherein:

said sheet material forms a u-shape when emplaced, said sheet material having a curved section facing toward the body of water.

6. A system, as claimed in claim 1, wherein:

said excavation has a substantially flat bottom surface, and a pair of opposing substantially perpendicular sides terminating at the surface of the ground.

7. A system, as claimed in claim 1, wherein:

said aggregate is selected from the group consisting of open graded rock, crushed stone, gravel, and combinations thereof.

8. A system, as claimed in claim 1, wherein:

said excavation includes a pair of excavations placed on opposite lateral sides of the body of water, said sheet material and said aggregate being placed in both said excavations.

9. A system, as claimed in claim 8, wherein:

said excavations are placed on opposite banks of a body of water in the form of a river or stream, and said scour platform has an upper surface that substantially matches a surrounding grade of the ground.

10. A system, as claimed in claim 9, wherein:

said plurality of micropiles extend into the ground at an angle wherein a lower end of at least one micropile of said plurality of micropiles extends under a bed of said river or stream.

11. A method of preventing erosion created by a river or stream, said method comprising the steps of:

digging excavations on opposite banks of the river or stream, said excavations having a width extending transversely from a flow direction of the river or stream, and a length extending along substantially a direction of flow of the river or stream;

placing sheet material on bottom surfaces of said excavations, said sheet material having ends extendable away from said excavations;

backfilling the excavations with aggregate;

folding the free ends over the aggregate to form a top cover;

backfilling the gaps between said sheet material and said excavations;

emplacing a plurality of micropiles spaced from one another along the banks of the river or stream and placed between edges of the river or stream and the excavations, said plurality of micropiles being placed within the ground at an angle wherein a lower end of at least one micropile of said plurality of micropiles extends under a bed of the river or stream.

* * * * *